United States Patent [19]

Kinzler

[11] Patent Number: 4,909,904

[45] Date of Patent: Mar. 20, 1990

[54] HEADBOX FOR A PAPER MACHINE WITH DILUTION FEED LINES BEFORE A TURBULENCE GENERATOR

[75] Inventor: Gernot Kinzler, Heidenheim-Mergelstetten, Fed. Rep. of Germany

[73] Assignee: J.M. Voith GmbH, Heidenheim, Fed. Rep. of Germany

[21] Appl. No.: 280,894

[22] Filed: Dec. 7, 1988

[30] Foreign Application Priority Data

Dec. 9, 1987 [DE] Fed. Rep. of Germany ..... 3741603

[51] Int. Cl.[4] ..... D21F 1/06

[52] U.S. Cl. ..... 162/343; 162/336; 162/344

[58] Field of Search ..... 162/216, 336, 343, 344, 162/258

[56] References Cited

U.S. PATENT DOCUMENTS

| | | | |
|---|---|---|---|
| 2,904,461 | 9/1959 | Washburn et al. | 162/216 |
| 3,407,114 | 10/1968 | Springuel | 162/258 |
| 3,547,775 | 12/1970 | Bossen et al. | 162/216 |
| 3,725,197 | 4/1973 | Dahl et al. | 162/216 |
| 3,970,513 | 7/1976 | Lehtinen | 162/343 |
| 4,414,062 | 11/1983 | Kirjavainen | 162/336 |

FOREIGN PATENT DOCUMENTS

| | | | |
|---|---|---|---|
| 2912152 | 10/1980 | Fed. Rep. of Germany . | |
| 3514544 | 3/1986 | Fed. Rep. of Germany | 162/216 |

*Primary Examiner*—Karen M. Hastings

*Attorney, Agent, or Firm*—Albert L. Jeffers; Anthony Niewyk

[57] ABSTRACT

A headbox features in the machine-wide suspension channel, following in the flow direction of the suspension, a tubular distributing grid, an equalization channel, a turbulence generator, and a nozzle. Connected to the suspension channel is a device for dispensation of diluting liquid into the suspension. The amount of diluting liquid is adjustable across the machine width in contingence on the position of the basis weight cross profile variation in the produced paper web. The diluting liquid is dispensed directly before a choking point of the turbulence generator, into the suspension channel, in order to thereby prevent hydraulic disturbances, specifically cross flows in the suspension flow in the nozzle.

4 Claims, 1 Drawing Sheet

HEADBOX FOR A PAPER MACHINE WITH DILUTION FEED LINES BEFORE A TURBULENCE GENERATOR

BACKGROUND OF THE INVENTION

The field of the invention is that of headboxes for a paper machine.

A headbox for dispensation of a suspension, consisting of fibers, filler and fine substances as well as chemical agents and water, on a running wire is for producing a paper web. The suspension stream dispensed by the headbox must have a constant thickness, equal velocity, equal stream direction and equal consistency (density) across a machine width. This produces a paper web with consistent properties across the machine width, specifically a consistent basis weight cross profile. Variations in the basis weight cross profile are sought to be eliminated in the following way.

A headbox for a paper machine is described in West German patent No. 2,912,152. Diluting liquid is supplied to the machine wide suspension channel in a quantity that is adjustable across the machine width. This compensates for variations in the basis weight of the finished web by influencing the density of the suspension. To that end, the diluting liquid is introduced in the suspension flow, the diluting liquid preferably being tail water that mixes well with the suspension. It is introduced in an area that is located between a cross distributor for the suspension supply and a turbulence generator of the headbox. Alternatively, the diluting liquid can be introduced either directly in the turbulence generator or in the outlet of the headbox coordinated with a cylinder.

This has a grave disadvantage due to the location and the way of feeding diluting liquid into the suspension flow. Because of those factors, there are hydraulic disturbances caused in the suspension flow. The effects of these hydraulic disturbances are greater in width the longer the travel of suspension from the admixture of the diluting liquid, up to the fixing of the fiber on the wire. Since the prior headbox does not feature partitions that guide the suspension flow, the disturbance can propagate unimpededly. An addition of diluting liquid that varies from the remaining area of the headbox causes cross flows which the turbulence generator, fashioned as a perforated roll, is unable to be eliminated. The result, therefore, is an unfavorable fiber orientation in adjoining areas of the paper web which a correction of the basis weight cross profile is not intended. Also, feeding the diluting liquid transverse to the suspension flow direction causes coarse turbulences in the suspension flow. These coarse turbulences can no longer be compensated for in the headbox and, therefore, lead to formation problems in the finished paper web.

Therefore, what is needed is a headbox for a paper machine able to influence the basis weight cross profile locally in a closely limited area without causing disturbances in the remaining web area.

SUMMARY OF THE INVENTION

One object of the present invention is to provide a headbox capable of influencing the basis weight profile locally in a closely limited area without causing disturbances in the remaining web area.

The present invention comprises a headbox for a paper machine. The headbox has a machine-wide suspension channel, a machine-wide turbulence generator, a machine-wide nozzle, and a dispensing device. The turbulence generator is arranged in the suspension channel and configured as a turbulence screen insert with a choking point on its approach side. The nozzle is arranged in the flow direction of the suspension with the nozzle delivering the suspension on a machine-wide running wire forming a layer on the wires. The dispensing device dispenses diluting liquid into the suspension channel. The quantity of diluting liquid is adjustable at any point and the dispensing occurs directly before the turbulence generator.

The present invention provides for hydraulic disturbance in the suspension flow, which is associated with the introduction of the diluting liquid to be compensated for by the effect of the choking point. The choking point follows the dispensation of the liquid directly in the flow direction, so that disturbing turbulences and cross flows are safely avoided. Thus, correcting the basis weight cross profile in a specific, narrowly limited area of the paper web width has no undesirable effect on adjoining areas of the web.

BRIEF DESCRIPTIONS OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
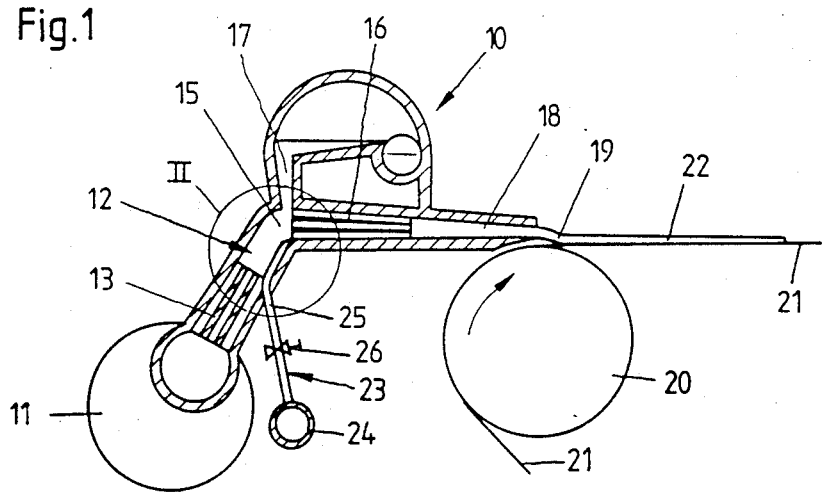
FIG. 1 shows a schematic diagram of a cross section of a headbox for a paper machine.
Figure 2:
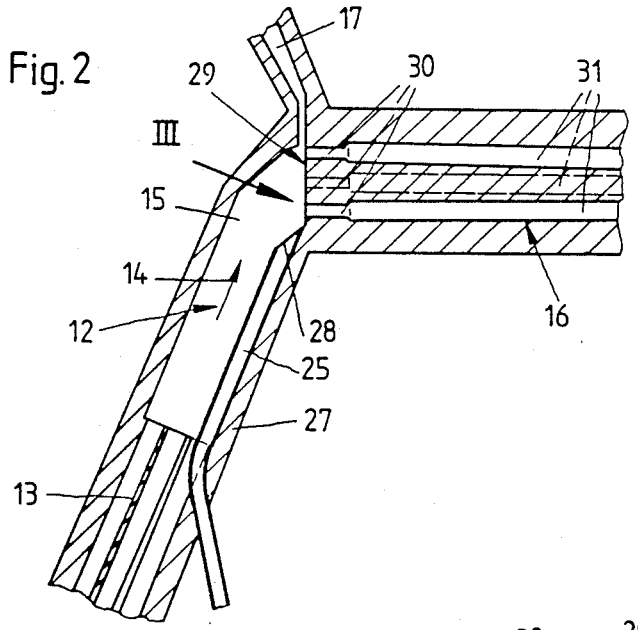
FIG. 2 shows a section of the headbox as enlarged diagram of the detail II in FIG. 1 with diluting liquid lines emptying in the suspension channel ahead of a turbulence generator.

In FIG. 1, a headbox 10 of a paper machine (not shown) is equipped with a flow spreader pipe 11 through which suspension is fed in a constant volume flow to a machine-wide suspension channel 12 of the headbox 10. Arranged at the start of the suspension channel 12 is a tubular distributing screen 13 for generating a consistent, highly turbulent substance flow across the machine width. As shown in FIG. 2, the tubular distributing screen 13 is followed in the direction of flow arrow 14 of the suspension by an equalizing channel 15. The channel 15 is followed, after a reversal of the suspension flow, by a turbulence generator 16 which comprises a turbulence screen insert. Ahead of the turbulence generator 16, an overflow channel 17 for excess suspension branches off upwardly from the equalization channel 15. Issuing from the turbulence generator with a short-wave turbulence of high intensity, the suspension passes through a machine-wide nozzle 18 of the suspension channel 12. The suspension flow in suspension channel 12 is accelerated and delivered on a running wire 21, at the suspension discharge gap 19 of the headbox 10. The suspension flow escapes as a machine-wide stream of even thickness, in the area of a breast roll 20. The suspension layer 22, contained on wire 21, is dewatered as usual and the tail water is recycled into the suspension circuit of the paper machine.

The headbox 10 is equipped with a device 23 for dispensation of diluting liquid into the suspension channel 12. This device 23 features a flow spreader pipe 24 to which tail water is fed as diluting liquid and which extends beside the flow spreader pipe 11 for the suspension. Originating from the flow spreader pipe 24 are a number of feed lines 25 for diluting liquid. These lines 25 are arranged parallel with one another, slightly spaced across the machine width. Each line features a valve 26 for adjustment of the volume flow of diluting liquid. The feed lines 25 empty into the suspension channel 12. They extend with a longitudinal axis which is approximately parallel with the flow direction, along a side wall 27 of the equalizing channel 15. The feed lines 25 end directly before the turbulence generator 16 of the headbox 10. Endwise, the feed lines 25 are beveled at an acute angle so that their outlet 28 opens with a full cross section against the section of the equalizing channel 15 that ends on the turbulence generator 16.

Figure 3:
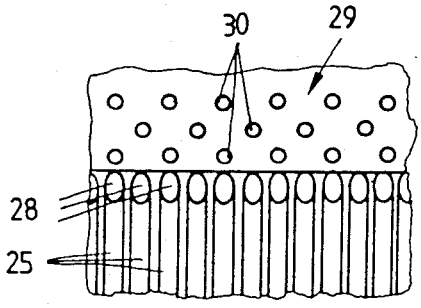
FIG. 3 shows a view of a section of the turbulence generator featuring choking bores, with lines for the diluting liquid, viewed in the direction of arrow III in FIG. 2.

Bordering directly on the equalization channel 15, on the approach side, the turbulence generator 16 is provided with a choking point 29. The choking point 29 is fashioned as a narrow bore 30 of short length which extends into a relatively long bore 31 of larger diameter in the direction toward the nozzle 18, both bores fashioned in the turbulence generator 16. One alternate embodiment has the turbulence generator 16 also equipped with pipes that are fashioned, in the same mode of operation as the bores 30 and 31, with a stepped cross section. The bores 30 in the turbulence generator 16, on the approach side, are arranged at a uniform pitch across the machine width (FIG. 3), but the pattern of pitch may also vary. The feed lines 25 are coordinated with the bores 30, flush, at the same pitch.

The presence of the tubular distributing screen 13 and equalization channel 15 as components is not essential, therefore, the flow spreader pipe 11 may also border directly on the turbulence generator 16.

The diluting liquid dispensed by the device 23 is fed to the headbox 10 at a ratio of 1:5 to 1:10 relative to the volume flow of the suspension. Assuming a basis weight cross profile that does not require correction and is free of defects, diluting liquid is fed from the individual feed lines 25 in a volume flow that is consistent across the machine width. An appropriate design of the hydraulic system of the headbox 10 and the device 23 assures that the two volume flows (suspension and diluting liquid) will unite at approximately identical velocity. Having approximately identical temperatures and similar chemical properties among the tail water, used as diluting liquid, and the suspension promotes the mixing of the two volume flows.

Variations in the basis weight cross profile of the paper web which occur in the paper making practice may have various causes. These variations can be influenced effectively in an equalizing way with the device 23 for dispensation of diluting liquid. Contingent on the location of the cross profile variation relative to the machine width, the supply of diluting liquid coordinated with the defective area is varied. This can be accomplished by a measuring device monitoring the basis weight profile, sending appropriate signals to the process control system of the paper machine. This activates corresponding valves 26 in the feed lines 25 to change the dispensation of diluting liquid. The correction may be effected in a very sensitive way by means of continuously adjustable valves 26. In the case of a defectively reduced basis weight, the dispensation of diluting liquid is reduced so that the density of the suspension will increase correspondingly and equalize the variation in the basis weight. Conversely, in the case of a rise of the basis weight beyond the specified value, the admixture of diluting liquid to the suspension is increased, thereby reducing the density with the result of reducing the basis weight. Depending on the width of the variation in the basis weight cross profile, these control operations may involve a number of partial volume flows of diluting liquid ejected by the feed lines 25. On the other hand, there may be an error on the basis weight cross profile which is locally very narrowly limited (i.e. error which occurs in a very narrow zone) and which is stable with time. Such an error can be eliminated by the activation of only one valve 26 in the respective feed line 25. The suspension which is displaced more or less by introduction of diluting liquid is compensated for via the overflow channel 17, so that a constant volume flow passes through the turbulence generator 16.

Changed due to variations in the basis weight cross profile, the discharge of diluting liquid from one or several feed lines 25 results in velocity differences at the mixing point of diluting liquid and suspension in the equalization channel 15. Disturbances which are caused thereby in the equalization channel 15 are prevented from propagating across the machine width because the outlet 28 of the feed lines 25 is followed directly by the choking point 29 of the turbulence generator 16. This choking point 29 has an equalizing effect on disturbances in the volume flow consisting of suspension and diluting liquid, so that an equal pressure prevails in the turbulence generator 16 across the machine width. Constant across the machine width, these pressure conditions are independent of the local density of the suspension. An equalization of these suspension density differences in the nozzle 18 is not possible until the suspension stream discharges from the suspension discharge gap 19.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the are to which this invention pertains and fall within the limits of the appended claims.

What is claimed is:

1. A headbox adapted to use with a paper machine, said paper machine defining a machine-width, comprising:

a machine-wide suspension channel:

a machine-wide turbulence generator arranged in said machine-wide suspension channel configured as a turbulence screen insert, said turbulence generator having a plurality of passages and a plurality of choking points on its approach side;

a machine-wide nozzle arranged in a flow direction of suspension with said nozzle delivering said suspension on a machine-wide running wire such that said suspension forms a layer on said wire;

dispensing means for dispensation of diluting liquid into said suspension channel, said dispensing means including means for adjusting the diluting liquid quantity across said machine-width, said dispensing means structured and arranged such that said dispensation occurs at said approach side of said turbulence generator; and feed lines for the diluting fluid arranged in close succession across said machine-width, said feed lines extending along a side wall of said headbox and inside said headbox, each feed line having an outlet which is beveled at an acute angle such that said feed lines end on an outlet side in said suspension channel with a longitudinal axis extending at least approximately parallel to said flow direction of said suspension to provide a constant volume of flow for said turbulence generator.

2. The headbox as described in claim 1 wherein each said choking point is formed in such a way that each passage of said turbulence screen insert has a narrow portion at its upstream end.

3. The headbox as described in claim 1 wherein each said choking point comprises a bore in said turbulence grid insert, each said feed line having at least one corresponding bore, such that each passage of said turbulence generator is coordinated with each said choking point, each said bore and corresponding line being positioned such that said outlet side provides a flow of diluting liquid directly over said bores, and each said bore and line combination being arranged at a constant pitch across said machine width.

4. Headbox according to claim 1 wherein each choking point is fashioned as a bore in the turbulence grid insert that is coordinated with each passage of the turbulence generator.

* * * * *